US008009125B2

(12) United States Patent
Kim

(10) Patent No.: US 8,009,125 B2
(45) Date of Patent: Aug. 30, 2011

(54) ORGANIC ELECTROLUMINESCENT DISPLAY DEVICE

(75) Inventor: Yang-Wan Kim, Suwon-si (KR)

(73) Assignee: Samsung Mobile Display Co., Ltd., Giheung-Gu, Yongin, Gyunggi-Do (KR)

( * ) Notice: Subject to any disclaimer, the term of this patent is extended or adjusted under 35 U.S.C. 154(b) by 1370 days.

(21) Appl. No.: 11/529,397

(22) Filed: Sep. 29, 2006

(65) Prior Publication Data

US 2007/0075937 A1 Apr. 5, 2007

(30) Foreign Application Priority Data

Sep. 30, 2005 (KR) ..... 10-2005-0092263

(51) Int. Cl.
*G09G 3/30* (2006.01)

(52) U.S. Cl. ..... 345/76; 345/77; 345/78; 345/79; 345/80; 345/81; 345/82; 345/83; 315/169.3

(58) Field of Classification Search ..... 345/1.1, 345/76–83
See application file for complete search history.

(56) References Cited

U.S. PATENT DOCUMENTS 6,529,180 B1 3/2003 Ito et al.
6,888,522 B1 5/2005 Shibata et al.
7,119,367 B2 10/2006 Yuki et al.
7,173,590 B2 * 2/2007 Uchino et al. ..... 345/92
7,184,006 B2 * 2/2007 Kim ..... 345/76
7,348,936 B2 * 3/2008 Lee et al. ..... 345/3.1
7,378,739 B2 * 5/2008 Kwak et al. ..... 257/758
7,479,955 B2 * 1/2009 Yoshida ..... 345/211
7,535,449 B2 * 5/2009 Miyazawa ..... 345/92
2002/0043941 A1 * 4/2002 Iketsu et al. ..... 315/169.3
2005/0253799 A1 * 11/2005 Kamio ..... 345/103

* cited by examiner

*Primary Examiner* — Richard Hjerpe
*Assistant Examiner* — Jeffrey Steinberg
(74) *Attorney, Agent, or Firm* — Robert E. Bushnell, Esq.

(57) ABSTRACT

In an organic electroluminescent (EL) display device, a main display panel and a sub display panel share a data line and a power supply voltage line. The organic EL display device has a top emission type main display panel and a bottom emission type sub display panel in a single display panel. The main display panel is composed of main pixels, each having a compensation circuit for compensating a threshold voltage, and the sub pixel display is composed of basic sub pixels without any compensation circuit. Each of the sub pixels has a boost capacitor which increases a data voltage, and which is disposed between a scan line and a storage capacitor so as to use the same voltage and power supply voltage as the main pixels. The sub pixels having the boost capacitor are disposed in the sub display panel, so that the main and sub display panels share the data line and the power supply voltage line.

20 Claims, 6 Drawing Sheets

ORGANIC ELECTROLUMINESCENT DISPLAY DEVICE

CLAIM OF PRIORITY

This application makes reference to, incorporates the same herein, and claims all benefits accruing under 35 U.S.C. §119 from an application for ORGANIC ELECTROLUMINESCENT DISPLAY DEVICE earlier filed in the Korean Intellectual Property Office on the $30^{th}$ of Sep. 2005 and there duly assigned Serial No. 10-2005-0092263.

BACKGROUND OF THE INVENTION

1. Technical Field

The present invention relates to an organic electroluminescent display device and, more particularly, to an organic electroluminescent display device having a pixel circuit which allows a main display panel and a sub display panel to share a data line and a power supply voltage line.

2. Related Art

An electroluminescent display device (hereinafter referred to an EL display device) is an emissive device in which a fluorescent material emits light when electrons and holes recombine to thereby display an image. EL display devices are classified into inorganic EL display devices which use an inorganic compound as the fluorescent material and organic EL display devices which use an organic compound as the fluorescent material. EL display devices have many advantages, such as low driving voltage, self-emission, thin film characteristics, wide viewing angle, fast response speed, high contrast, and so forth. Thus, EL display devices are expected to take center stage among the next generation of display devices. Among EL display devices, an organic EL display device can display an image having a high luminance of tens of thousands of [cd/m$^2$] with a voltage of about 10V. Thus, most EL display devices coming into widespread use are organic EL display devices.

Methods of driving an organic EL display device may be classified into passive matrix type methods and active matrix type methods which use a thin film transistor (TFT). The passive matrix type method has an anode electrode (i.e., indium-tin-oxide; ITO) and a cathode electrode (metal) arranged orthogonally, and selects an associated line for driving. The active matrix type method connects the TFT and a capacitor to respective pixel electrodes so as to maintain a voltage using the capacitance of the capacitor. Among these types, when the organic EL display device is driven by the passive matrix type driving method, a high instantaneous luminance is required. This consumes a large amount of power and reduces the lifespan of the organic light emitting diode. As a result, almost all recently manufactured organic EL display devices are driven by the active matrix type driving method. Such an active matrix type organic EL display device (AMOLED) is applied to various devices, including cellular phones, personal digital assistants (PDAs), electronic dictionaries, and so forth.

In particular, a dual emission organic EL display device, which has a main display panel and a sub display panel in one, is increasing in use. The main display panel and the sub display panel have different sizes and display different images. For example, in a folder type cellular phone, an inner window for displaying main images (picture, background, characters, menu, etc.) when the folder is opened is the main display panel, and an outer window for displaying simpler images (time, date, etc.) when the folder is closed is the sub display panel.

SUMMARY OF THE INVENTION

The present invention, therefore, provides an organic electroluminescent (EL) display device which shares a data line and a power supply voltage line in main and sub display panels.

In an exemplary embodiment according to the present invention, an organic EL display device comprises: a main display panel having a plurality of main pixels for displaying a main image; a sub display panel having a plurality of sub pixels for displaying a sub image; a main scan driver for applying a main scan signal to select the main pixels; a sub scan driver for applying a sub scan signal to select the sub pixels; and a main/sub data driver for supplying a main or sub data signal to the main or sub pixels. The main and sub pixels arranged in the same column share the same data line and the same power supply voltage line.

In another exemplary embodiment according to the present invention, an organic EL display device comprises: a main display panel having a plurality of main pixels for displaying a main image and a sub display panel having a plurality of sub pixels for displaying a sub image wherein each of the sub pixels has an organic light emitting diode (OLED) for emitting light at a luminance corresponding to a predetermined drive current; a drive transistor connected between the OLED and a power supply voltage line for generating a drive current corresponding to a voltage applied to a gate terminal thereof; a switching transistor connected between a data line and the gate terminal of the drive transistor for delivering a data voltage in response to a scan signal from a scan line connected to the gate terminal; a storage capacitor having a first electrode connected to the power supply voltage line and a second electrode connected to the gate terminal of the drive transistor for temporarily storing the data voltage for a constant time; and a boost capacitor connected between the scan line and the second electrode of the storage capacitor for increasing a voltage of the gate terminal of the drive transistor in response to the scan signal converted to a high level

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Hereinafter, exemplary embodiments of the present invention will be described in detail with reference to accompanying drawings.

Figure 1:
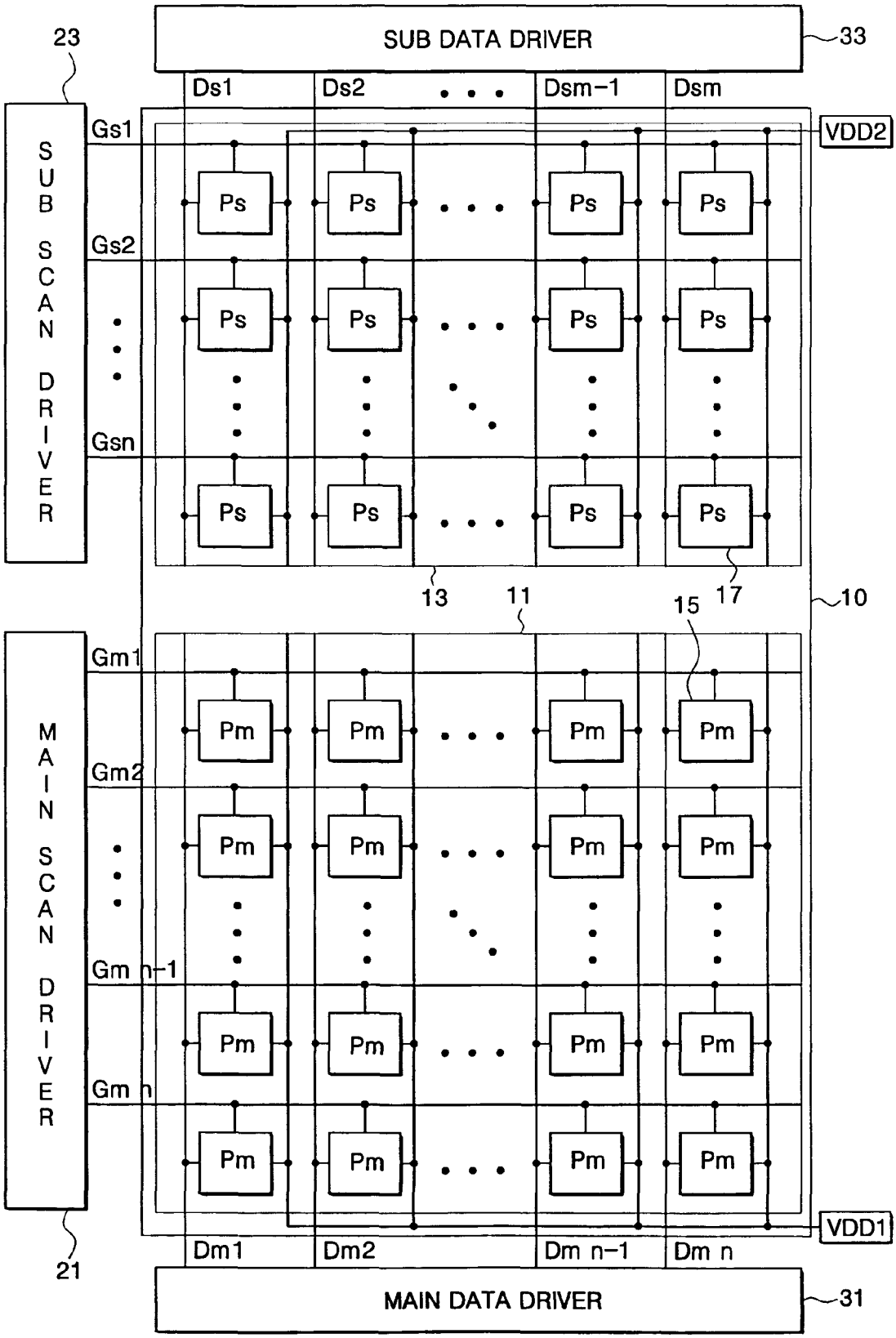
FIG. 1 is a block diagram of a dual emission organic electroluminescent (EL) display device.

FIG. 1 is a block diagram of a dual emission organic electroluminescent (EL) display device.

Referring to FIG. 1, the organic EL display device has a display panel 10, a main scan driver 21, a sub scan driver 23, a main data driver 31, and a sub data driver 33.

The display panel 10 is composed of a main display panel 1 for displaying main images and a sub display panel 13 for displaying sub images.

The main display panel 11 has a plurality of main pixels Pm for displaying the main images, a plurality of main data lines Dm1 to Dmn for delivering main data signals to the main pixels Pm, a plurality of main scan lines Gm1 to Gmn for delivering scan signals to the main pixels Pm, and a first power supply voltage line VDD1 for supplying current to the main pixels Pm.

The sub display panel 13 has a plurality of sub pixels Ps for displaying the sub images, a plurality of sub data lines Ds1 to Dsm for delivering sub data signals to the sub pixels Ps, a plurality of scan lines Gs1 to Gsn for delivering scan signals to the sub pixels Ps, and a second power supply voltage line VDD2 for supplying current to the main pixels Ps.

The main scan driver 21 is connected to the main scan lines Gm1 to Gmn, and supplies scan signals to the main display panel 11 when displaying the main images.

The sub scan driver 23 is connected to the sub scan lines Gs1 to Gsn, and supplies scan signals to the sub display panel 13 when displaying the sub images.

The main data driver 31 is connected to the main data lines Dm1 to Dmn, and converts the main data signals from digital signals to analog signals so as to apply the converted signals to the main display panel 11.

The sub data driver 33 is connected to the sub data lines Ds1 to Dsm, and converts the sub data signals from digital signals to analog signals so as to apply the converted signals to the sub display panel 13.

According to the dual emission organic EL display device as described above, the main display panel 11 and the sub display panel 13 are disposed on one display panel 10. However, all components and lines are separately formed and independently driven.

In addition, the main display panel 11 is a top emission type display panel so that main pixels having a compensation circuit for compensating threshold voltages of drive transistors can be designed. However, the sub display panel 13 is a bottom emission type display panel so that the compensation circuit cannot be employed due to a limitation in layout, and only a basic sub pixel structure (i.e., two transistors and one capacitor, which will be described with reference to FIG. 3) can be employed. In this case, the main pixel and the sub pixel are different in range of the data voltage and the power supply voltage so that the data line and the power supply voltage line cannot be shared. Hereinafter, the main and sub pixels will be described.

Figure 2:
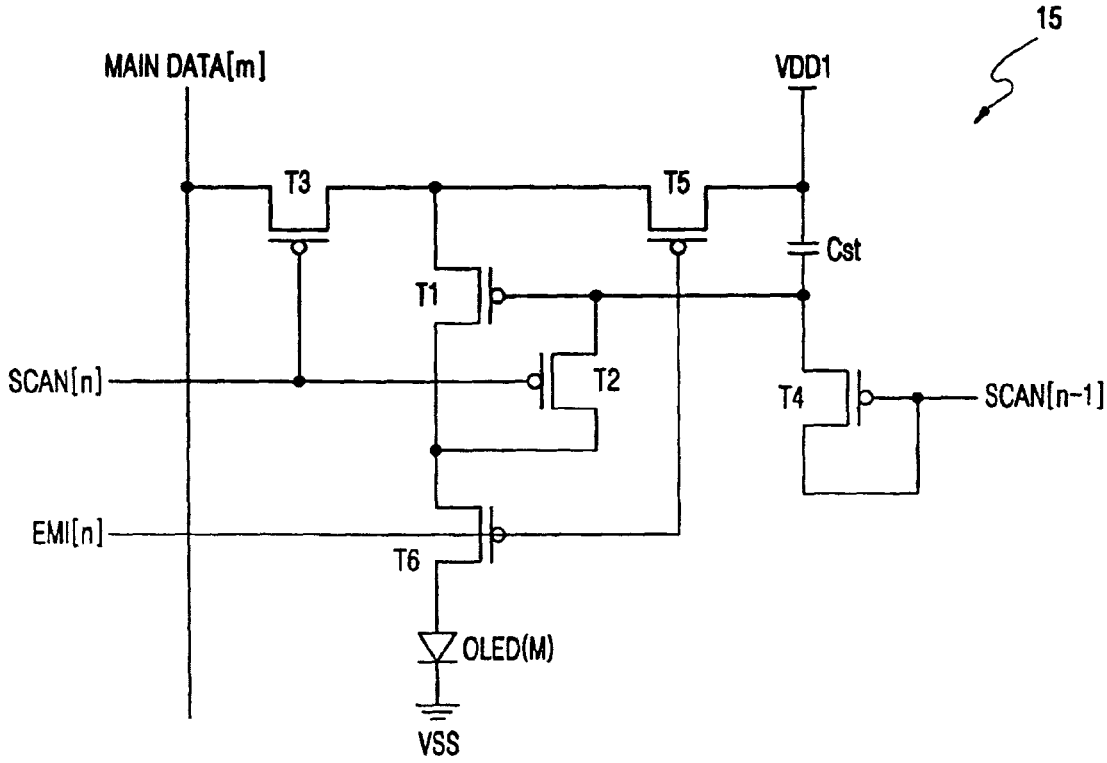
FIG. 2 is a circuit diagram of a main pixel formed in the main display panel shown in FIG. 1.

FIG. 2 is a circuit diagram of a main pixel formed in the main display panel shown in FIG. 1.

Referring to FIG. 2, pixels 15 formed in the main display panel 11 have a compensation circuit for compensating for the threshold voltage deviation of the drive transistor as described above.

That is, each of the main pixels 15 has an organic EL diode OLED(M) which emits light with a predetermined luminance in response to a drive current, a drive transistor T1 for generating the drive current to be supplied to the organic EL diode OLED(M), and a threshold voltage compensation transistor T2 for compensating for the threshold voltage Vth of the drive transistor T1.

In addition, the main pixel 15 has a switching transistor T3 for delivering data signals, a capacitor Cst for maintaining a gate voltage of the drive transistor for a constant time, an initialization transistor T4 for initializing the capacitor Cst, a power supply voltage application transistor T5 for delivering a power supply voltage VD to the drive transistor T1, and an emission control transistor T6 for allowing the drive current generated in the drive transistor T1 to flow to the organic EL diode OLED(M) or for interrupting the drive current. All of these transistors T1 to T6 are P channel Metal Oxide Semiconductor (PMOS) transistors.

The drive current $I_{OLED(M)}$ flowing to the organic EL diode OLED(M) of the main pixel having the compensation circuit, as described above, may be expressed by Equation 1:

$$\begin{aligned} I_{OLED(M)} &= K(Vgs - |Vth|)^2 \\ &= K(VDD1 - (Vmdata - |Vth|) - |Vth|)^2 \\ &= K(VDD1 - Vmdata)^2 \end{aligned} \quad \text{[Equation 1]}$$

The drive current $I_{OLED(M)}$ flowing to the main pixel as expressed in Equation 1 may not depend on the deviation of the threshold voltage, and may be expressed as a first power supply voltage VDD1 and a main data voltage Vmdata.

Figure 3:
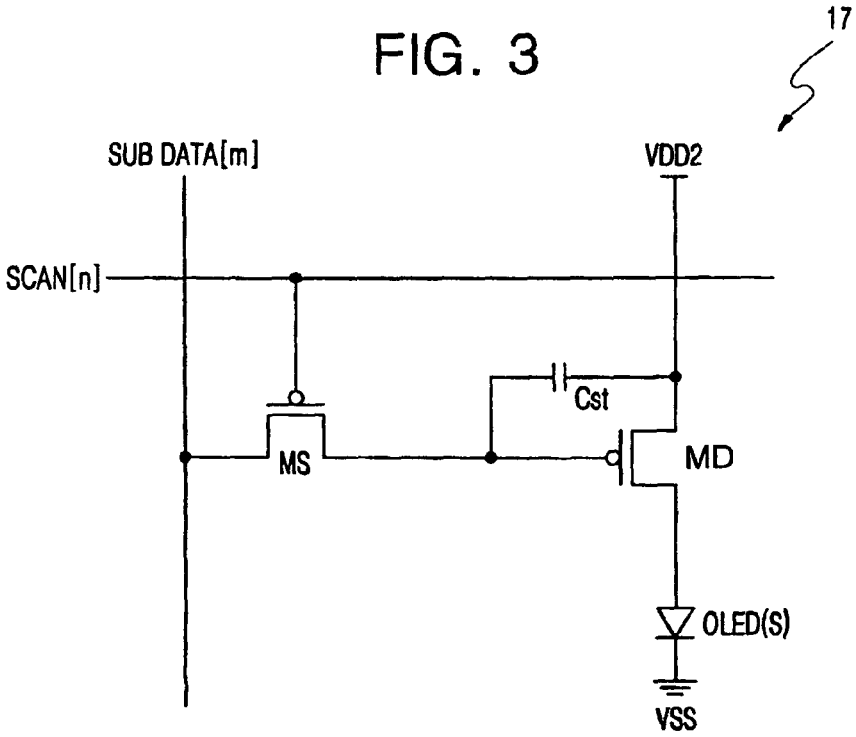
FIG. 3 is a circuit diagram of a sub pixel formed in the sub display panel shown in FIG. 1.

FIG. 3 is a circuit diagram of a sub pixel formed in the sub display panel shown in FIG. 1.

Referring to FIG. 3, each of the sub pixels 17 is composed of two PMOS transistors MD and MS, one capacitor Cst, and an organic EL diode OLED(S).

A drive transistor MD is connected between a second power supply voltage line VDD2 and an organic EL diode OLED(S), and generates a drive current $I_{OLED(s)}$ corresponding to the voltage applied to its gate terminal.

A switching transistor MS is connected between a sub data line SUB DATA[m] and the gate terminal of the drive transistor MD, has a gate terminal connected to a scan line SCAN [n], and delivers a sub data voltage Vsdata in response to a scan signal supplied from the scan line SCAN[n].

A storage capacitor Cst is connected between the second power supply voltage line VDD2 and the gate terminal of the drive transistor MD, and temporarily stores the sub data voltage Vsdata delivered from the switching transistor MS.

A drive current $I_{OLED(S)}$ flowing to the organic EL diode OLED of the sub pixel as described above may be expressed by Equation 2:

$$\begin{aligned} I_{OLED(s)} &= K(Vgs - |Vth|)^2 \\ &= K(VDD2 - Vsdata - |Vth|)^2 \end{aligned} \quad \text{[Equation 2]}$$

The drive current flowing $I_{OLED(S)}$ flowing to the sub pixel depends on the deviation of the threshold voltage as expressed in Equation 2.

The drive currents are different, even when the same data voltage is applied to each of the main and sub pixels as expressed in Equations 1 and 2, so that the luminances of the main and sub display panels are also different.

Accordingly, the main display panel 11 and the sub display panel 13 cannot share the data line and the power supply voltage line, so that they have respective data drivers, which in turn causes the cost and power consumption to increase due to the two applied power supply voltages.

Figure 4:
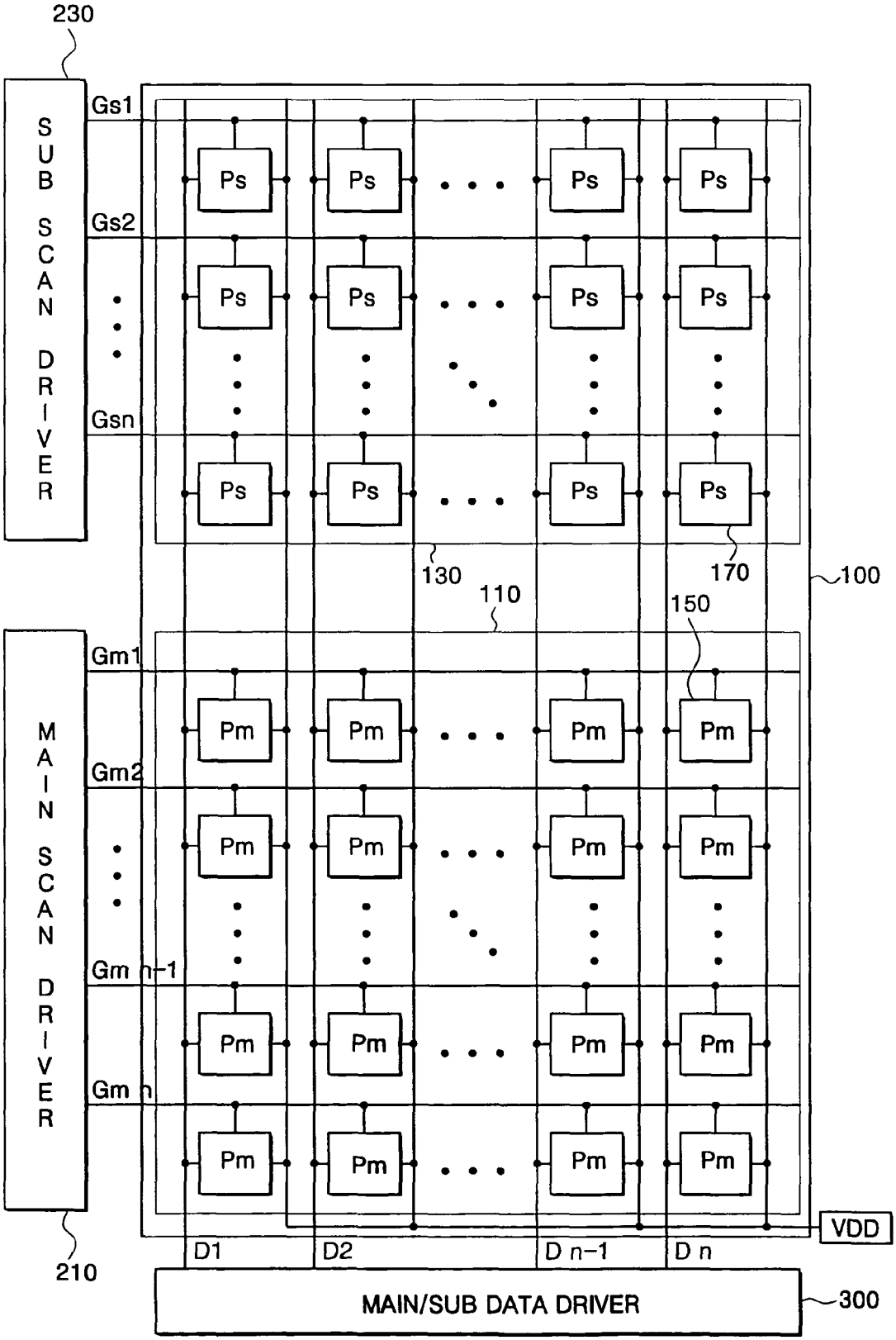
FIG. 4 is a block diagram of a dual emission organic EL display device in accordance with an exemplary embodiment of the present invention.

FIG. 4 is a block diagram of a dual emission organic EL display device in accordance with an exemplary embodiment of the present invention.

Referring to FIG. 4, the dual emission organic EL display device according to an exemplary embodiment of the present invention includes a display panel 100, a main scan driver 210, a sub scan driver 230, and a main/sub data driver 300.

The display panel 100 is composed of a main display panel 110 for displaying main images, and a sub display panel 130 for displaying sub images. In the case of a folder type cellular phone, the main display panel 110 is used as an inner window for displaying main images such as picture, character, menu, game, or the like, and the sub display panel 130 is used as an outer window for displaying sub images such as time, date, or the like.

The main display panel 110 has a plurality of main pixels Pm displaying main images, a plurality of data lines D1 to Dn for delivering data signals to the main pixels Pm, a plurality of main scan lines Gm1 to Gmn for delivering scan signals to the main pixels Pm, and a power supply voltage line VDD for supplying current to the main pixels Pm.

The sub display panel 130 has a plurality of sub pixels Ps for displaying sub images, a plurality of data lines D1 to Dn for delivering data signals to the sub pixels Ps, a plurality of sub scan lines Gs1 to Gsn for delivering scan signals to the sub pixels Ps, and a power supply voltage line VDD for supplying current to the main pixels Ps.

In this case, the main display panel 110 used as the inner window has a top emission structure so that it may use a pixel having a compensation circuit for compensating for the threshold voltage of a drive transistor. However, the sub display panel 130 used as the outer window has a bottom emission structure so that it uses a basic pixel without the compensation circuit.

The main scan driver 210 is connected to the main scan lines Gm1 to Gmn, and supplies the scan signals to the main display panel 110 when displaying the main images.

The sub scan driver 230 is connected to the sub scan lines Gs1 to Gsn, and supplies the scan signals to the sub display panel 130 when displaying the sub images.

The main/sub data driver 300 is connected to the data lines D1 to Dn, and converts main or sub data signals from digital signals to analog signals so as to apply the converted signals to the main display panel 110 or the sub display panel 130.

According to the an exemplary embodiment of the present invention as described above, the main display panel 110 and the sub display panel 130 share the same main/sub data driver 300, the same data lines D1 to Dn, and the same power supply voltage line VDD.

That is, the main and sub pixels arranged in the same column among the main pixels Pm and the sub pixels Ps share the same data line and power supply voltage line. For example, the main pixel Pm and the sub pixel Ps arranged in an $n^{th}$ column are connected to an $n^{th}$ data line Dn and an $n^{th}$ power supply voltage line VDD in common to receive data signals from the main/sub data driver 300.

As such, when the main/sub data driver 300, the data line Dn, and the power supply voltage line VDD are shared, the main display panel 110 and the sub display panel 130 must emit light at the same luminance, even when the same data voltage is applied thereto. To this end, the present invention proposes a novel sub pixel structure Ps of the sub display panel 130, which is different from that of the related art. Detailed structures of the main and sub pixels will be described later.

In addition, the organic EL display device according to the exemplary embodiment of the present invention shares the main/sub data driver 300 and the data line Dm so that the main display panel 110 and the sub display panel 130 cannot be displayed at the same time. Accordingly, the main scan driver 210 is driven in order to display the main image, and the sub scan driver 230 is driven in order to display the sub image. Preferably, the main scan driver 210 and the sub scan driver 230 operate selectively.

Figure 5:
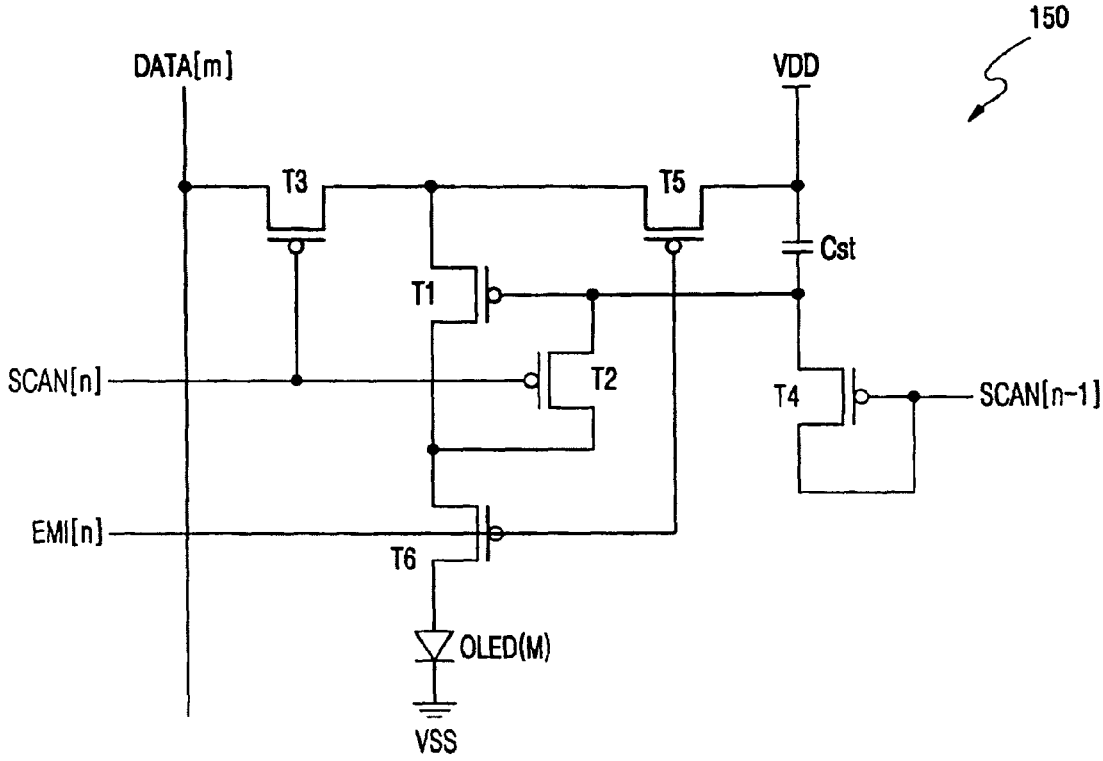
FIG. 5 is a block diagram of a main pixel formed in the main display panel shown in FIG. 4.

FIG. 5 is a block diagram of a main pixel formed in the main display panel shown in FIG. 4 in accordance with an exemplary embodiment of the present invention.

Referring to FIG. 5, each of the pixels 150 formed in the main display panel 110 has a compensation circuit for compensating for the deviation of the threshold voltage of the drive transistor, as in the pixel shown in FIG. 2.

Each main pixel 150 has an organic EL diode OLED(M) for emitting light at a predetermined luminance in response to a value of the drive current, a drive transistor T1 for generating the drive current to be supplied to the organic EL diode OLED(M), and a threshold voltage compensation transistor T2 for compensating for the threshold voltage Vth of the drive transistor T1. In addition, the main pixel 150 has a switching transistor T3 for delivering data signals, a capacitor Cst for maintaining a gate voltage of the drive transistor T1 for a constant time, an initialization transistor T4 for initializing the capacitor Cst, a power supply voltage application transistor T5 for delivering a power supply voltage VDD to the drive transistor T1, and an emission control transistor T6 for allowing the drive current generated in the drive transistor T1 to flow to the organic EL diode OLED(M) or for interrupting the drive current. All of these transistors T1 to T6 are PMOS transistors.

The drive current OLED(M) flowing to the organic EL diode OLED(M) may be expressed by Equation 3:

$$\begin{aligned} I_{OLED(M)} &= K(Vgs - |Vth|)^2 \\ &= K(VDD - (Vdata - |Vth|) - |Vth|)^2 \\ &= K(VDD - Vdata)^2 \end{aligned} \quad \text{[Equation 3]}$$

The drive current $I_{OLED(M)}$ flowing to the main pixel as expressed in Equation 3 may not depend on the deviation of the threshold voltage, and may be expressed as a power supply voltage VDD and a data voltage Vdata.

It will be appreciated by those skilled in the art that the pixel structure shown in FIG. 5 only illustrates an exemplary embodiment of the present invention, that the present invention is not limited thereto, and that any pixel circuits having a compensation circuit for compensating the threshold voltage of the drive transistor to generate the drive current expressed in Equation 3 may be employed.

Figure 6:
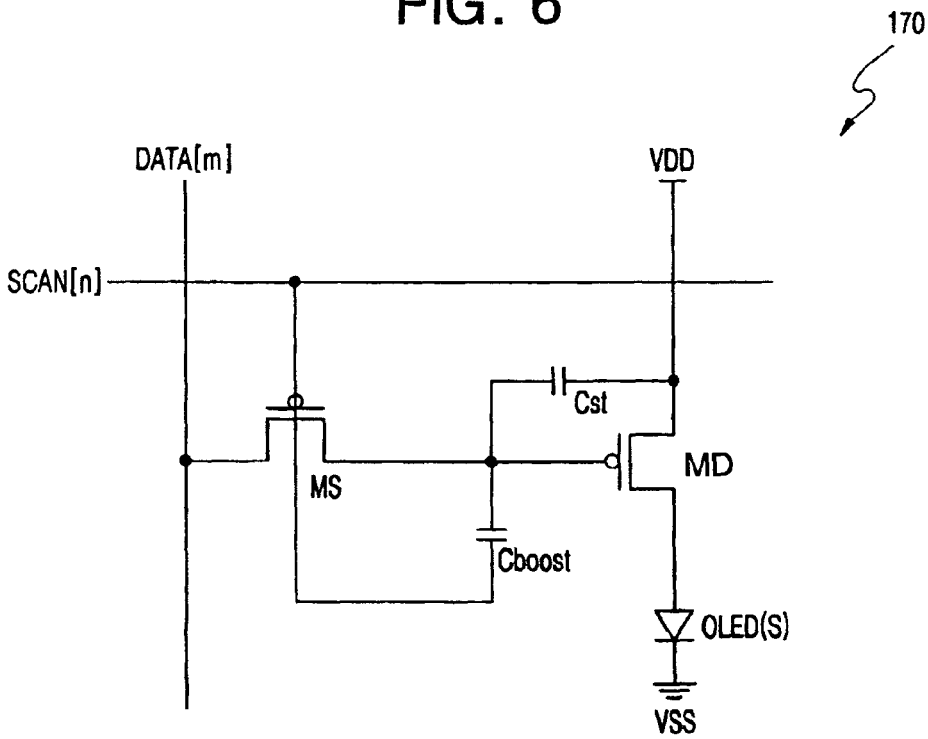
FIG. 6 is a block diagram of a sub pixel formed in the sub display panel shown in FIG. 4.
Figure 7:
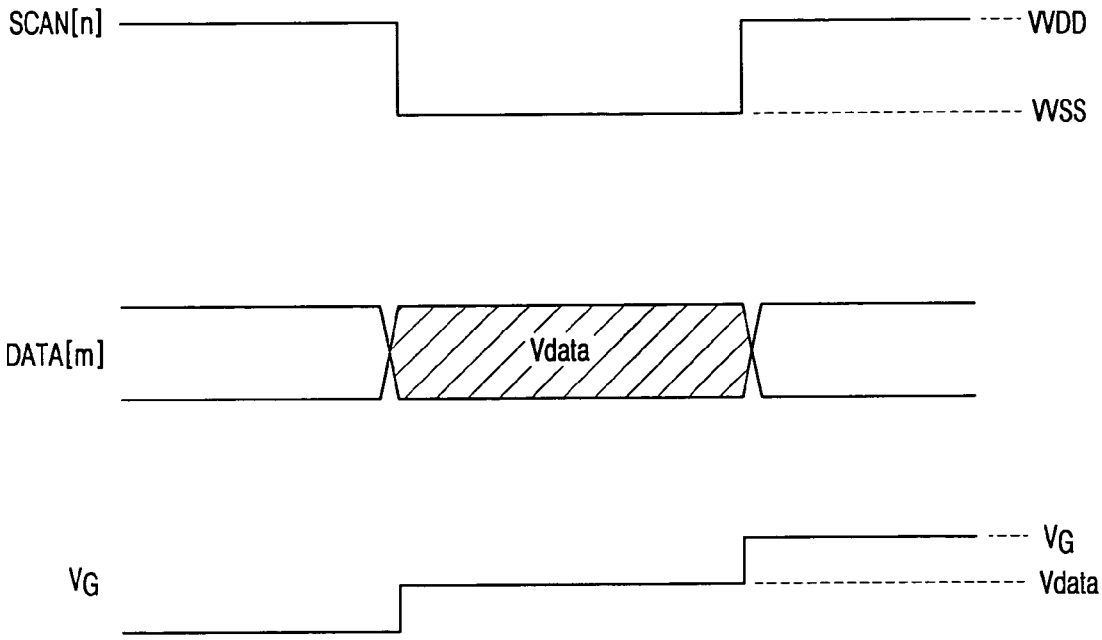
FIG. 7 is a timing diagram for operating the pixel circuit shown in FIG. 6.

FIG. 6 is a block diagram of a sub pixel formed in the sub display panel shown in FIG. 4 in accordance with an exemplary embodiment of the present invention, and FIG. 7 is a timing diagram for the operation of the pixel circuit shown in FIG. 6.

Referring to FIGS. 6 and 7, each of the sub pixels 170 has two PMOS transistors MD and MS, two capacitors Cst and Cboost, and an organic EL diode OLED(S).

A drive transistor MD is connected between a power supply voltage line VDD and the organic EL diode OLED(S), and generates a drive current $I_{OLED(s)}$ corresponding to the voltage applied to its gate terminal.

A switching transistor MS is connected between a data line DATA[m] and the gate terminal of the drive transistor MD, has a gate terminal connected to a scan line SCAN[n], and delivers a data voltage Vdata in response to a scan signal from the scan line SCAN[n].

A storage capacitor Cst is connected between the power supply voltage line VDD and the gate terminal of the drive transistor MD, and temporarily stores the data voltage Vdata delivered by the switching transistor MS.

A boost capacitor Cboost is connected between the gate terminal of the drive transistor MD and the scan line SCAN [n], and increases the voltage of the gate terminal of the drive transistor MD in response to a level change of the scan signal. The capacitance of the boost capacitor Cboost according to an exemplary embodiment of the present invention is less than that of the storage capacitor Cst.

The pixel shown in FIG. 6 has been designed with a PMOS transistor. However, it will be appreciated by those skilled in the art that the pixel may be designed with an NMOS transistor with reference to FIG. 6, so that a description of the pixel circuit using the NMOS transistors will be skipped.

Operation of the pixel circuit shown in FIG. 6 will now be described with reference to the timing diagram shown in FIG. 7.

When a scan signal of low level VVSS is first applied to the gate terminal of the switching transistor MS, the switching transistor MS is turned on so as to apply the data voltage Vdata from the data line DATA[m] to the storage capacitor Cst and one terminal of the boost capacitor Cboost.

In this case, a charge Q1 of the storage capacitor Cst is Cst(VDD−Vdata), and a charge Q2 of the boost capacitor Cboost is Cboost(Vdata−VVSS).

When a scan signal of high level VVDD is then applied to the gate terminal of the switching transistor MS, the switching transistor MS is turned off. In this case, the voltage of the one terminal of the boost capacitor Cboost is changed in response to the change in the voltage level of the scan line (VVSS->VVDD). In this case, a charge Q1 of the storage capacitor Cst is Cst(VDD−$V_G$), and a charge Q2 of the boost capacitor is Cboost($V_G$−VVDD).

The storage capacitor Cst and the boost capacitor Cboost are connected in series with each other, so that a change in the charge stored in each of the capacitors is the same. That is, ΔQ1 is equal to ΔQ2. In this case, ΔQ1 is a value of the changed charge of the storage capacitor Cst, and ΔQ2 is a value of the changed charge of the boost capacitor Cboost.

Accordingly, the voltage applied to the gate terminal of the drive transistor MD is expressed by Equation 4:

$$\Delta Q1 = \Delta Q2$$

$$Cst\{(VDD-Vdata)-(VDD-V_G)\} = Cboost\{(Vdata-VVSS)-(V_G-VVDD)\}$$

$$V_G = Vdata + Cboost(VVDD-VVSS)/(Cst+Cboost) \quad \text{[Equation 4]}$$

In this case, $V_G$ indicates a gate terminal voltage of the drive transistor MD, VVDD indicates a scan signal of high level, and VVSS indicates a scan signal of low level.

Accordingly, because of the presence of the boost capacitor Cboost, the gate terminal voltage $V_G$ of the drive transistor MD has such a value that a correction voltage Cboost (VVDD−VVSS)/(Cst+Cboost) is added to the data voltage Vdata as expressed in Equation 4.

Consequently, the drive current $I_{OLED(s)}$ flowing through the sub pixel 150 according to an exemplary embodiment of the present invention may be expressed by Equation 5:

$$\begin{aligned} I_{OLED(s)} &= K(Vgs-|Vth|)^2 \quad \text{[Equation 5]} \\ &= K(VDD-V_G-|Vth|)^2 \\ &= K(VDD-(Vdata-Vboost)-|Vth|)^2 \\ &= K(VDD-Vdata+(Vboost-|Vth|))^2, \\ &= K(VDD-Vdata)^2 \text{ when } Vboost=|Vth| \end{aligned}$$

where Vboost is equal to Cboost(VVDD−VVSS)/(Cst+Cboost) [V], and Vth is a threshold voltage of the drive transistor MD.

Accordingly, the correction voltage Vboost of the sub pixel is designed so as to be equal to |Vth| as expressed in Equation 5, and the sub pixel has the same drive current value as in Equation 3 for the main pixel.

Consequently, the main display panel 110 and the sub display panel 130 may share the same data driver, the same data line, and the same power supply voltage line, so that the same luminance may be obtained at the same data voltage.

To prove such results, the data voltage applied to the pixel circuit of FIG. 5 was applied to each of the pixel circuits shown in FIGS. 3 and 6 so that the current value flowing through each of the pixel circuits was measured.

Figure 8:
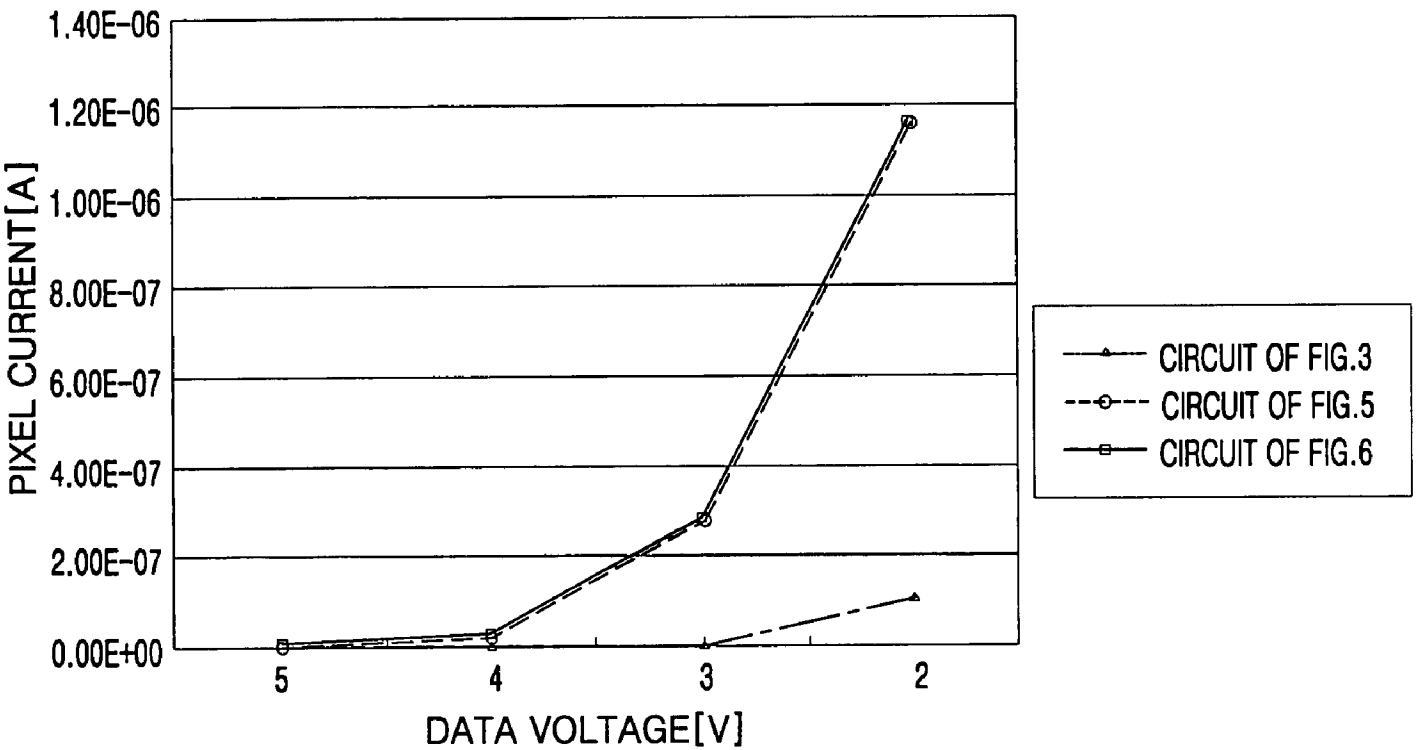
FIG. 8 shows the results of comparing the drive current in the circuit shown in FIG. 3 and the drive current measured when the same data voltage is applied to each of the pixel circuits shown in FIGS. 5 and 6 in accordance with an exemplary embodiment of the present invention.

FIG. 8 shows the results of comparing the drive current in the circuit shown in FIG. 3 and the drive current measured when the same data voltage is applied to each of the pixel circuits shown in FIGS. 5 and 6 in accordance with an exemplary embodiment of the present invention.

Referring to FIG. 8, the same power supply voltage VDD and the same data voltage Vdata were used for the main display panel 110 and the sub display panel 130, and it was designed so that the storage capacitor Cst formed in the sub pixel 170 has a value of 0.5[PF] and the boost capacitor Cboost has a value of 0.05[PF].

Accordingly, the compensation pixel circuit shown in FIG. 5, and the pixel circuit further including the boost capacitor Cboost shown in FIG. 6, according to the exemplary embodiment of the present invention showed the same drive current value when a data voltage of about 5V to 2V was applied, as shown in FIG. 8. However, it can be seen that the desired drive current value was not generated in the basic pixel circuit shown in FIG. 3.

The boost capacitor Cboost is added to the sub pixel Ps formed in the sub display panel 130 in the organic EL display device according to the exemplary embodiment of the present invention as described above, so that the same driver, the same data line, and the same power supply voltage line may be shared by the main display panel 110 and the sub display panel 130. Accordingly, the cost is reduced and the aperture ratio is enhanced because two data drivers are reduced to one data driver, and unnecessary power consumption is reduced because two power supply voltages are reduced to one power supply voltage.

As described above, the organic EL display device of the present invention shares main and sub data drivers as one data driver, so that the cost is reduced and the aperture ratio is enhanced.

In addition, the present invention shares one power supply voltage line and uses the same power supply voltage, instead of using two different power supply voltage lines for the main and sub display panels, so that the power consumption is reduced.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. An organic electroluminescent (EL) display device, comprising:

a main display panel having a plurality of main pixels for displaying a main image;

a sub display panel having a plurality of sub pixels for displaying a sub image;

a main scan driver for applying a main scan signal for selecting the main pixels;

a sub scan driver for applying a sub scan signal for selecting the sub pixels; and a main/sub data driver for supplying one of a main data signal and a sub data signal to one of the main pixels and the sub pixels;

wherein the main pixels and the sub pixels arranged in the same column share a same data line and a same power supply voltage line.

2. The organic EL display device according to claim 1, wherein each of the sub pixels comprises:

an organic EL diode (OLED) for emitting light at a luminance corresponding to a predetermined drive current;

a drive transistor connected between the OLED and the power supply voltage line for generating a drive current corresponding to a voltage applied to a gate terminal thereof;

a switching transistor connected between the data line and the gate terminal of the drive transistor for delivering a data voltage in response to a scan signal from a scan line connected to the gate terminal;

a storage capacitor having a first electrode connected to the power supply voltage line and a second electrode connected to the gate terminal of the drive transistor for temporarily storing the data voltage for a constant period of time; and a boost capacitor connected between the scan line and the second electrode of the storage capacitor for increasing a voltage of the gate terminal of the drive transistor in response to the scan signal converted to a high level.

3. The organic EL display device according to claim 2, wherein the boost capacitor has a capacitance less than a capacitance of the storage capacitor.

4. The organic EL display device according to claim 3, wherein the voltage increased by the boost capacitor is expressed as:

$$Vboost=Cboost(VVDD-VVSS)/(Cst-Cboost) \quad [V],$$

where Vboost indicates the increased voltage, Cst indicate a magnitude of the storage capacitor, Cboost indicates a magnitude of the boost capacitor, VVDD indicates a magnitude of the scan signal having the high level, and VVSS indicates a magnitude of the scan signal having a low level.

5. The organic EL display device according to claim 4, wherein the voltage increased by the boost capacitor is equal to an absolute value of a threshold voltage of the drive transistor.

6. The organic EL display device according to claim 5, wherein the drive transistor and the switching transistor of said each of the sub pixels are transistors having a same conductivity type.

7. The organic EL display device according to claim 6, wherein the drive transistor and the switching transistor of said each of the sub pixels are one of a P-channel Metal Oxide Semiconductor (PMOS) and an N-channel Metal Oxide Semiconductor (NMOS).

8. The organic EL display device according to claim 1, wherein each of the main pixels has a compensation circuit for compensating a threshold voltage of a drive transistor.

9. The organic EL, display device according to claim 1, wherein the main scan driver and the sub scan driver are selectively driven.

10. The organic EL display device according to claim 1, wherein the main display panel and the sub display panel are arranged in a single display panel.

11. The organic EL, display device according to claim 10, wherein the main display panel is a top emission display panel, and the sub display panel is a bottom emission display panel.

12. An organic electroluminescent (EL) display device comprising a main display panel having a plurality of main pixels for displaying a main image and a sub display panel having a plurality of sub pixels for displaying a sub image, each of the sub pixels comprising:

an organic light emitting diode (MED) for emitting light at a luminance corresponding to a predetermined drive current;

a drive transistor connected between the OLED and a power supply voltage line for generating a drive current corresponding to a voltage applied to a gate terminal thereof;

a switching transistor connected between a data line and the gate terminal of the drive transistor for delivering a data voltage in response to a scan signal from a scan line connected to the gate terminal;

a storage capacitor having a first electrode connected to the power supply voltage line and a second electrode connected to the gate terminal of the drive transistor for temporarily storing the data voltage for a constant period of time; and a boost capacitor connected between the scan line and the second electrode of the storage capacitor for increasing a voltage of the gate terminal of the drive transistor in response to the scan signal converted to a high level.

13. The organic EL display device according to claim 12, wherein the main pixels and the sub pixels arranged in the same column share a same data line and a same power supply voltage line.

14. The organic EL display device according to claim 13, wherein the boost capacitor has a capacitance less than a capacitance of the storage capacitor.

15. The organic EL display device according to claim 14, wherein the voltage increased by the boost capacitor is expressed as:

$$Vboost=Cboost(VVDD-VVSS)/(Cst+Cboost) \quad [V],$$

where Vboost indicates the increased voltage, Cst indicate a magnitude of the storage capacitor, Cboost indicates a magnitude of the boost capacitor, VVDD indicates a magnitude of the scan signal having the high level, and VVSS indicates a magnitude of the scan signal having a low level.

16. The organic EL display device according to claim 15 wherein the voltage increased by the boost capacitor is equal to an absolute value of a threshold voltage of the drive transistor.

17. The organic EL display device according to claim 16, wherein the drive transistor and the switching transistor of said each of the sub pixels are transistors having a same conductivity type (a P-channel Metal Oxide Semiconductor (PMOS) and an N-channel Metal Oxide Semiconductor (NMOS)).

18. The organic EL display device according to claim 12, wherein each of the main pixels has a compensation circuit for compensating a threshold voltage of the drive transistor.

19. The organic EL display device according to claim 12, wherein the main display panel and the sub display panel are arranged in a single display panel.

20. The organic EL display device according to claim 19, wherein the main display panel is a top emission display panel, and the sub display panel is a bottom emission display panel.

* * * * *